United States Patent [19]

Funk

[11] 4,257,608

[45] Mar. 24, 1981

[54] GOLFER'S SETUP DEVICE

[76] Inventor: Charles R. Funk, 5182 Avenida Primera, Tucson, Ariz. 85704

[21] Appl. No.: 2,940

[22] Filed: Jan. 12, 1979

Related U.S. Application Data

[63] Continuation-in-part of Ser. No. 840,966, Oct. 11, 1977, abandoned.

[51] Int. Cl.[3] ..... A63B 69/36

[52] U.S. Cl. ..... 273/187 R

[58] Field of Search ..... 273/187 R, 187 A, 187 B, 273/32 H; 35/29 A

[56] References Cited

U.S. PATENT DOCUMENTS

| | | | |
|---|---|---|---|
| 1,517,555 | 12/1924 | Graham | 273/187 R |
| 2,150,580 | 3/1939 | Crowley | 273/187 R |
| 2,457,351 | 12/1948 | Crowley | 273/187 R |
| 3,229,981 | 1/1966 | Taber | 273/187 R |
| 3,253,830 | 5/1966 | Laskin | 273/187 R |
| 3,343,268 | 9/1967 | Schennum | 273/187 R X |
| 3,638,950 | 2/1972 | Hyotlaine | 273/187 R |
| 3,658,344 | 4/1972 | Kimble | 273/187 R |

FOREIGN PATENT DOCUMENTS

| | | | |
|---|---|---|---|
| 1261524 | 1/1972 | United Kingdom | 273/187 R |

*Primary Examiner*—George J. Marlo
*Attorney, Agent, or Firm*—Connolly and Hutz

[57] ABSTRACT

Positioning device for golfer consists essentially of lateral scale strip about 30 to about 36 inches long and about 1¼ inches wide, two short foot-aligning strips adjustably mounted on the lateral scale strip, and a perpendicular scale strip that slides along as well as perpendicularly to the lateral scale strip for location of the ball, club head, and for alignment of shaft. The slide for the perpendicular scale strip can have an auxiliary slideway into which the perpendicular scale strip can be slid to hold it parallel to lateral scale strip for compact storage.

6 Claims, 7 Drawing Figures

GOLFER'S SETUP DEVICE

This application is in part a continuation of application Ser. No. 840,966 filed Oct. 11, 1977 now abandoned.

The present invention relates to the game of golf and more particularly to equipment for use in such game.

Among the objects of the present invention is the provision of novel equipment to help a golfer set himself up for a stroke at the golf ball.

The foregoing as well as additional objects of the present invention are more fully expounded in the following description of several of its exemplifications, reference being made to the accompanying drawings in which FIG. 1 is a plan view of the novel equipment of the present invention, showing it lying on the ground and in operating position;

According to the present invention an improved positioning device for a golfer consists essentially of (a) a lateral scale strip about 30 to about 36 inches long and about $1\frac{1}{4}$ inches wide, (b) two foot-aligning strips each at least about 8 inches long but not longer than about half the length of the lateral scale strip, one foot-aligning strip being pivotally secured near one end of the lateral scale strip and the other foot-aligning strip being slidably and pivotally mounted to slide along and pivot with respect to the lateral scale strip, the mounting for the foot-aligning strips having a set of aligning indicators to show the inclination of those strips, and (c) a perpendicular scale strip about as long as the lateral scale strip, the perpendicular scale strip being mounted for non-pivotal sliding along the lateral scale strip as well as for non-pivotal sliding perpendicularly with respect to the lateral scale strip.

A short club-swing-aligning strip can be pivotally secured to one end of the perpendicular scale strip.

In a preferred form of the invention the slide mounting for the perpendicular scale strip has a first slideway along which the perpendicular scale strip slides perpendicularly to the lateral scale strip, and a separate slideway for holding the perpendicular scale strip aligned with and against the length of the lateral scale strip.

It is particularly desirable to provide the lateral scale strip with an upper surface at least a six-inch length of which is free of scale markings, to provide a space for inscribing notes. Large arrows can be applied to the upper surface of some of the components to help guide the user in setting up the apparatus.

Figures 1, 2, 3, 5, 6:
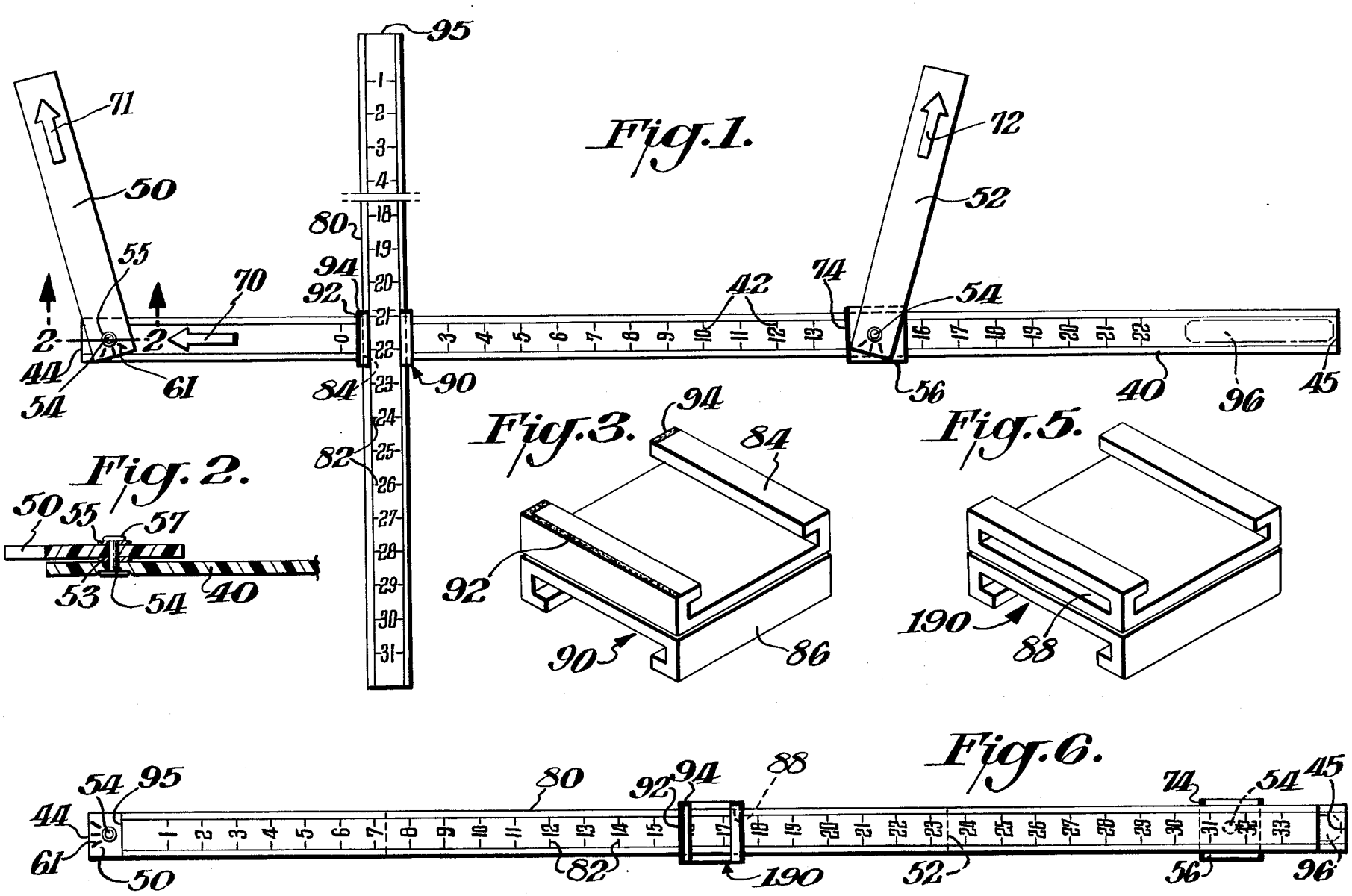
FIG. 2 is a broken-away sectional detail of the construction of FIG. 1, taken along line 2—2.
FIG. 3 is an isometric view of one of the slides in the apparatus of FIG. 1.
FIG. 5 is an isometric view similar to FIG. 3 of a modified form of the slide of FIG. 3.
FIG. 6 shows a modified apparatus placed in compact condition for storage.

Turning now to the drawings, the apparatus of FIG. 1 has a lateral scale strip 40 provided with scale markings 42 and having pivotally mounted near one end 44, a foot-aligning strip 50. The strip 50 is readily secured in place by a rivet 54 that penetrates through holes drilled or molded into both strips, preferably with a washer 53 inserted between the strips. Another washer 55 can be placed over the shank of the rivet to provide an anvil surface against which the tail 57 of the rivet is clinched. Rivet 54 can be tightly clinched in place so that strip 50 does not freely swing around the shank of the rivet, but requires a definite effort to move to different angular positions with respect to strip 40. Alternatively a spring washer or spring and washer, or the like, can be fitted under the head of the rivet to press the strips together and increase the frictional resistance against rotation of strip 50.

Markings 61 on strip 50 adjacent its pivoted end indicate the degree of tilt of strip 50 with respect to strip 40, so that the user can note the desired tilt position and reproduce it when he reuses the equipment. Cooperating aligning marks can also be placed on strip 40, if desired. The aligning marks can be carried by a length of paper, foil, textile, plastic, or the like, adherently held on the strips and also carrying a large arrow 70 or 71. The arrow is preferably at least about $\frac{1}{4}$ inch wide and at least about two inches long, so that it is readily distinguished from a distance of about six feet.

A second foot-aligning strip 52 is similarly pivotally mounted on a slide 56 that partially envelops the narrow width of lateral scale strip 40 and is slidable along that strip. One of the edges 74 of slide 56 extending transversely of the direction in which that slide slides, can be specially designated as by a printed-on or cemented-on marker, to indicate the slide edge against which scale markings 42 are to be read, although this is not needed. The location of the slide can very readily be determined by eyeing its center in relation to the scale markings on either side. Aligning marks on slide 56 can also be applied if desired.

Also mounted on lateral scale strip 40 is perpendicular scale strip 80 having its own scale markings 82. Strip 80 is slidably fitted in a first slideway 84 of a cross slide 90, so that strip 80 can be slid in a perpendicular direction with respect to lateral strip 40. Cross slide 90 also partially envelops the narrow width of strip 40 to provide another slideway 86 by which it can slide to and fro along the length of that strip. One edge 92 of cross slide 90 can also be specially designated as the edge to be used for reading scale 42, and another edge 94 designated as the one against which scale 82 is to be read, although again these are not needed.

Both slides can be retained on strip 40 by thickening its end 45 or by securing at that end a stud that prevents removal of the slides. Not only does this keep the slides from being removed and lost, but it keeps them from being remounted in reoriented position that shifts the designated edges of the slides, if their edges are marked to show where the scales are to be read.

It will be noted that cross slide 90 can be made by taking two slides 66 and cementing or fusing them together back-to-back. A single extrusion can thus be used to make an elongated length of plastic that can be cut into short lengths to make individual slides 56, and another extrusion can be used to make the strips. A total of only two extrusions can thus be used.

The modified cross slide 190 of FIG. 5 also has an additional slideway 88 into which strip 80 can be inserted after that strip is removed from slideway 84. When fitted in slideway 88 strip 80 is held parallel to and alongside lateral scale strip 40 so as to make the apparatus more compact and thus more readily storable, as shown in FIG. 6. By also folding both foot-aligning strips 50, 52 against strip 40 as shown in FIG. 6, the apparatus is then reduced to a very narrow long assembly that readily fits into a golf bag. The length of the assembly also keeps it from getting too low in a golf bag, so that it can readily be removed from the bag without groping around inside it.

Making the strip members about 1¼ inches wide provides a very effective and sturdy apparatus. These members can be about ⅛ inch thick and made of a plastic such as acrylonitrile-butadiene-styrene, commonly called ABS. The scale markings can be applied by printing an ink directly on the strips or by cementing on a paper, foil, textile or plastic facing that carries the scale. The 1¼ inch width provides ample space, as at 96, for inscribing such things as advertising as well as notes recording position markings for different golf strokes. This space should extend at least about six inches along the length of strip 40.

Figure 4:
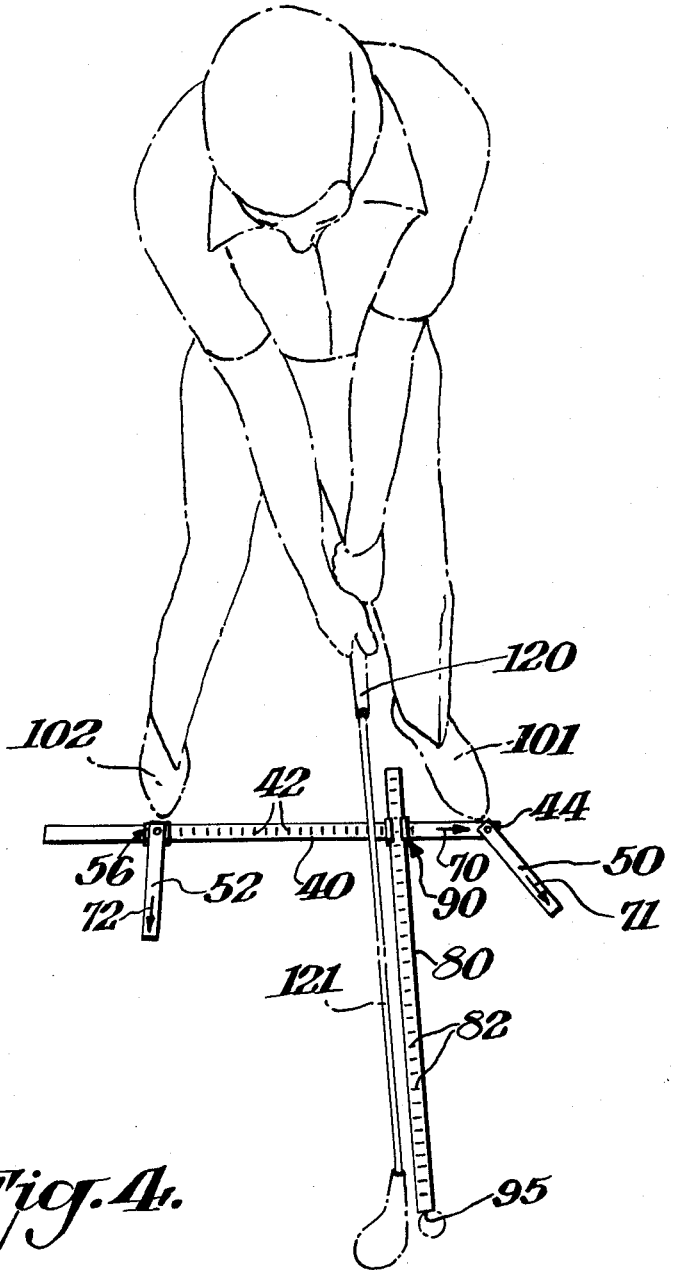
FIG. 4 is a perspective view from above and in front, showing a golfer setting himself up for a stroke at the ball with the help of the apparatus of FIG. 1.

One or both foot-aligning strips can carry an indicator arrow 71, 72 similar to arrow 70, to indicate the direction in which the golfer's shoes are to point, as illustrated in FIG. 4. These arrows can be placed close to the pivot points of these strips, so that it is easier to simultaneously apply that arrow along with the markings 61.

FIG. 4 illustrates the set-up or stance control provided by the apparatus of the present invention. The golfer can with or without the help of a golfing instructor or professional ("pro"), get his feet, body, hands, club and ball in proper orientation, and the equipment adjusted to match, as indicated in this Figure.

Thus the lateral scale strip 40 is placed on the ground with its arrow pointing toward the target the golfer is attempting to reach, and with its front end 44 touching the tip of the golfer's front foot shoe 101. The slide 56 is slid to a position at which it touches the tip of the golfers back shoe 102, and both foot-aligning strips pivoted so that they are oriented in the directions in which the respective shoes 101, 102 point.

Perpendicular scale strip 80 is then slide to the position that brings its outer tip 95 against the golf ball.

The golfer can then note the readings on scale 42, 82, as well as the location of alignment marks 61 on each foot-aligning strip, and these readings recorded as by inscribing them in a book or writing them in space 96. Slides 56 and 90 can have their surfaces facing the upper surface of strip 40, relieved a little so as not to rub against the writings on space 96, or against the scale markings 42.

After the set-up of FIG. 4 is completed the perpendicular strip can be slid away from the ball a bit and the golfer can then swing at the ball. The apparatus can then be transferred to the ball's new locations, and there set up again. The same set-up can be used if the same stroke is to be attempted.

It will be noted that the shaft 121 of the golf club 120 will seem to the eye to be parallel to the perpendicular strip, when the set-up is properly made. This is of further help to the golfer in using the equipment of the present invention. Not only does it enable him to plant his feet properly with respect to the ball, but also helps assure him that he is holding the golf club properly.

Different golf strokes call for different stances. Thus FIG. 4 shows the set-up for a drive, but shorter advances of the golf ball as when the ball is in rough ground or in a sand trap, utilize shorter clubs that do not reach as far from the golfer's body and are held differently. Also a putter club is usually still shorter and the putting stance quite different. A series of set-up notes can accordingly be inscribed to cover all situations.

A set-up apparatus of the present invention can be used with either right-handed or left-handed golfers. In FIG. 4 the golfer is right-handed; a left-handed golfer stands on the opposite side of the golf ball as seen in that Figure, the lateral scale strip 40 is also moved to the opposite side of the ball with arrow 70 on that strip still facing the same direction, and each foot-aligning strip rotated to point in the general direction of the golf ball. The inclination of the foot-aligning strips is then noted with respect to different alignment marks on the lateral strip, if that strip contains such marks. The perpendicular scale strip can be withdrawn from slideway 84 and reinserted after turning it end-for-end face-up, so that the scale markings 82 are right-side-up to the left-handed golfer.

Not only is a single apparatus of the present invention suitable for golfers of either hand, but it can also be used by men, women or children, regardless of their height and build. For any of these golfers the apparatus will define the orientation of the feet, the width of the stand, the location of the ball, and the orientation of the club, and help define the position of the hands as well as the body posture. It permits the methodical disciplined practice routine so important to the development of a good golf stroke. It also permits controlled experimentation to determine the effect of stance variables and thus overcome common defects such as those that cause a slice, fade, hook or too low or too high a ball trajectory.

The compactness of the compacted assembly is shown in the modification of FIG. 6, and in such condition the equipment is easily stored and carried anywhere. It takes up very little space in a golf bag and does not detract from its club-carrying effectiveness. Deploying such assembly, or folding it into compact condition, is very simply effected. All it takes for deployment is the withdrawal of strip 80 from slideway 88, reinsertion into slideway 84, and tilting out the foot strips 50, 52. Reversing these steps accomplishes the compacting.

Strips 50, 52 and 80 need not be as wide as strip 40, and can be made as narrow as 1 inch or even ¾ inch if desired. Some of the markings for scale 42 are not needed and can be omitted. Thus the position of slide 90 is pretty much confined to the left-hand end of scale 42 as seen in FIG. 1, and the slide for strip 52 to the right-hand end, so that the central third of the scale is really not needed and can be replaced by an additional blank space for notes or advertising or the like.

Instead of riveting the strips 50, 52 in place, they can be pivotally secured by screws, such as self-tapping or sheet metal screws that anchor themselves in the body of the member to which these strips are pivoted. Such screws can be fitted through openings in the strips large enough to pass the screw shanks without binding.

Figure 7:
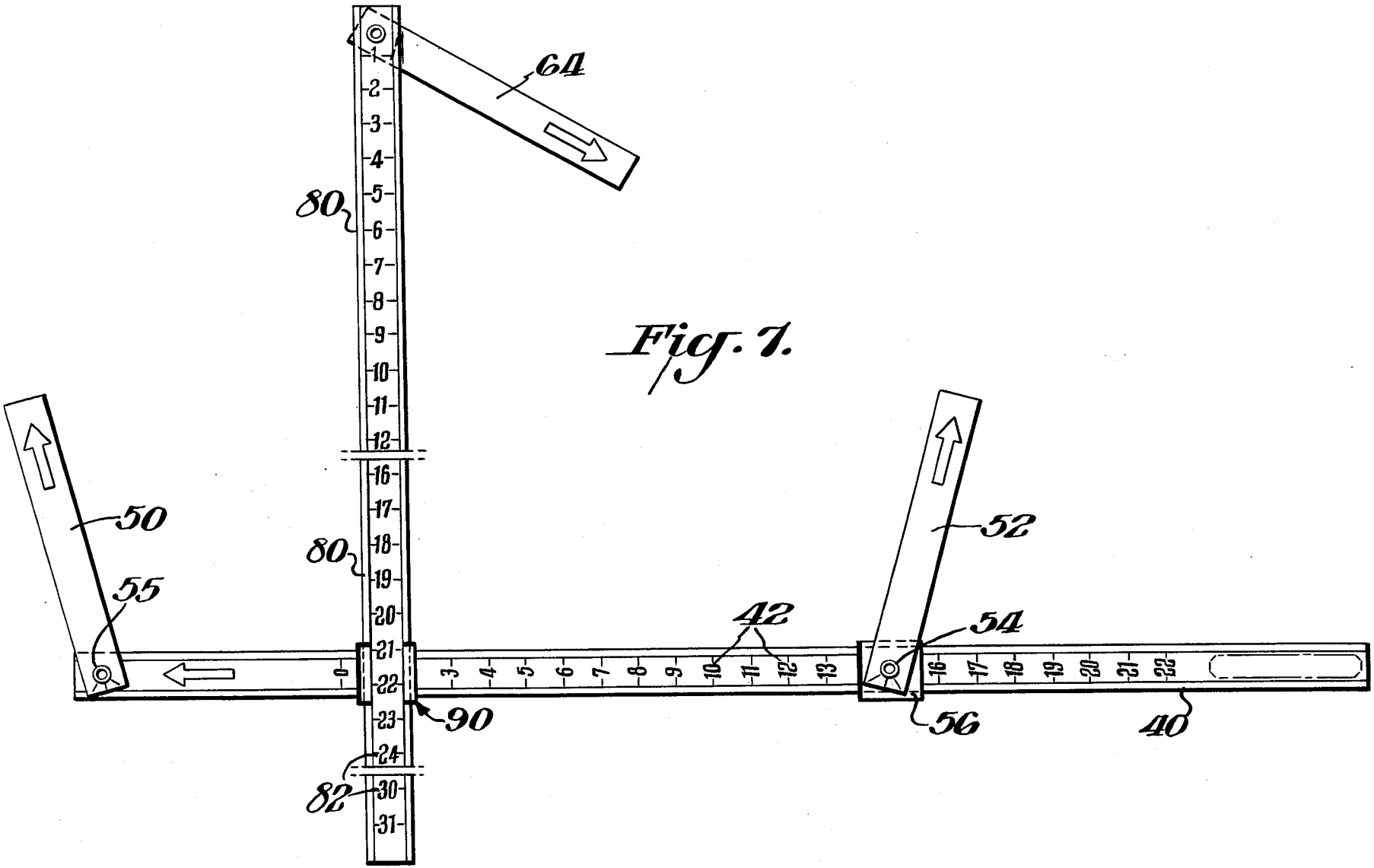
FIG. 7 is a plan view similar to FIG. 1 of another modified form of the equipment of the present invention.

It is helpful to pivotally mount on one end of the perpendicular scale strip, a club-swing-aligning strip to assist a beginner in preparing for the swing. FIG. 7. shows such a construction in which a strip 64 is rivetted to the outer end 95 of the perpendicular scale strip in a manner similar to the way the foot-aligning strips are mounted. Strip 64 can be frictionally pivoted to the illustrated position for example, to hold itself in that position and indicate to the golfer that when he brings his golf club back away from the ball (the "takeaway" or back stroke) in his final preparation for a drive swing, the club traces a path in the direction pointed by strip 64. Beginning golfers tend to bring the golf club back in the takeaway in a direction substantially perpendicular to strip 80, and this carries them into an incorrect swing stance.

The inclination of swing-aligning strip 64 can be different for different golfers, so that markings can be applied to the strip 64 and/or 80 to show the inclination desired.

A feature of the device of the present invention is that it is not only simple, inexpensive and compact, but it provides so many critically-needed guides for a proper golf swing. Thus the following items are accomplished:

(a) the spacing of the feet,
(b) the separate orientation of each foot,
(c) the location of the ball with respect to the feet,
(d) the orientation of the club shaft at the beginning of the back-stroke,
(e) the angle at which the club-head moves at the beginning of the back-stroke (and in the swing itself),
(f) setting up items (a) through (e) differently for different strokes or different golfers, and
(g) provision for noting down each adjustment position for the foregoing items, including scale markings, so that a set-up can be duplicated exactly. No other set-up guide items are needed.

The swing-aligning strip does not add any significant construction complexity, and for storage that strip pivots to a position overlying perpendicular scale strip 80, so that the compactness of the device is not altered. It still consists essentially of the members illustrated in FIG. 1.

Obviously many modifications and variations of the present invention are possible in the light of the above teachings. It is, therefore, to be understood that within the scope of the appended claims the invention may be practiced otherwise than as specifically described.

What is claimed:

1. A positioning device for a golfer, said device consisting essentially of (a) an unslotted lateral scale strip about 30 to about 36 inches long and about $1\frac{1}{4}$ inches wide,
(b) two correspondingly narrow foot-aligning strips each at least about 8 inches long but not longer than about half the length of the lateral scale strip, one foot-aligning strip being pivotally secured near one end of the lateral scale strip and the other foot-aligning strip being slidably and pivotally mounted to slide along and pivot with respect to the lateral scale strip, the pivotal engagements requiring a definite effort to effect pivotal rotation and the mounting for the foot-aligning strips having a set of aligning indicators to show the inclination of those strips, and
(c) an unslotted perpendicular scale strip about as long and as wide as the lateral scale strip, the perpendicular scale strip being mounted for non-pivotal sliding along the lateral scale strip as well as for non-pivotal sliding and removal perpendicularly with respect to the lateral scale strip, the lateral scale strip having an upper surface at least a six-inch length of which is free of scale markings to provide a space for inscribing notes.

2. The combination of claim 1 in which the perpendicular scale strip has pivotally secured to one end, a short swing-aligning strip frictionally held to keep itself in a position in which it makes an acute angle with the perpendicular scale strip.

3. The combination of claim 2 in which the swing-aligning strip is also about as wide as the lateral strip and the mounting for the perpendicular scale strip is a slide just wide enough to envelop a strip and having a first slideway along which the perpendicular scale strip slides perpendicularly to the lateral scale strip along with a separate slideway for holding the perpendicular scale strip aligned with and against the length of the lateral scale strip.

4. The combination of claim 3 in which at least one foot-aligning strip also carries an arrow large enough to be read from about six feet away and pointed toward the free end of the strip that carries it.

5. The combination of claim 4 in which the lateral scale strip separately carries an arrow pointing toward the end near which the pivotally-secured foot-aligning strip is secured, the arrow being at least about $\frac{1}{4}$ inch wide and at least about two inches long.

6. The combination of claim 1 in which the slidable mountings consist essentially of narrow slides that partially envelop the lateral strip, and the foot-aligning strips are arranged to pivot into positions in which they are essentially within the confines of the lateral strip so that the device can be stored in highly compact condition.

* * * * *